US011305314B2

(12) United States Patent
Tazzoli

(10) Patent No.: US 11,305,314 B2
(45) Date of Patent: Apr. 19, 2022

(54) SEPARATOR SCREEN IN DISCS OR STARS FOR WASTE, AXLE USABLE IN SUCH SCREEN AS WELL AS METHOD FOR MODIFYING A SEPARATOR SCREEN IN DISCS OR STARS FOR WASTE

(71) Applicant: GEO S.A.S. DI TAZZOLI ANTONIO & C., Breganze (IT)

(72) Inventor: Antonio Tazzoli, Breganze (IT)

( * ) Notice: Subject to any disclaimer, the term of this patent is extended or adjusted under 35 U.S.C. 154(b) by 0 days.

(21) Appl. No.: 15/733,721

(22) PCT Filed: Apr. 8, 2019

(86) PCT No.: PCT/IB2019/052875

§ 371 (c)(1),
(2) Date: Oct. 5, 2020

(87) PCT Pub. No.: WO2019/197969

PCT Pub. Date: Oct. 17, 2019

(65) Prior Publication Data

US 2021/0154704 A1 May 27, 2021

(30) Foreign Application Priority Data

Apr. 12, 2018 (IT) ..... 102018000004449
Apr. 12, 2018 (IT) ..... 102018000004450

(51) Int. Cl.
*B07B 1/15* (2006.01)
*B07B 1/46* (2006.01)

(52) U.S. Cl.
CPC ..... *B07B 1/155* (2013.01); *B07B 1/46* (2013.01)

(58) Field of Classification Search
CPC .... B07B 1/55; B07B 1/46; B07B 1/14; B07B 1/15; B07B 1/155
See application file for complete search history.

(56) References Cited

FOREIGN PATENT DOCUMENTS

| | | | | |
|---|---|---|---|---|
| DE | 102007027846 | | 5/2008 | |
| DE | 102015103549 | | 9/2015 | |
| EP | 2926915 | | 10/2015 | |
| EP | 3085462 | | 10/2016 | |
| WO | WO-2017081365 | A1 * | 5/2017 | ..... B07B 1/526 |

* cited by examiner

*Primary Examiner* — Michael McCullough
*Assistant Examiner* — Jessica L Burkman
(74) *Attorney, Agent, or Firm* — Themis Law

(57) ABSTRACT

An axle useable in a disc or star separator screen for waste includes a rotation shaft defining a longitudinal axis, a plurality of discs or stars integrally coupled with the rotation shaft, and a plurality of anti-clogging sleeves mounted idle on the rotation shaft, each of the anti-clogging sleeves being interposed between a respective pair of consecutive discs or stars. Each anti-clogging sleeve has a first rotating element and a second rotating element arranged adjacent to each other, at least one of which is a tubular body. The rotating elements are mounted idle on the rotation shaft so as to rotate independently with respect to each other.

15 Claims, 15 Drawing Sheets

SEPARATOR SCREEN IN DISCS OR STARS FOR WASTE, AXLE USABLE IN SUCH SCREEN AS WELL AS METHOD FOR MODIFYING A SEPARATOR SCREEN IN DISCS OR STARS FOR WASTE

FIELD OF THE INVENTION

The present invention can be applied to the technical field of separator screens, and it particularly regards a disc or star separator screen for waste and an axle useable in such screen.

The invention also regards a method for modifying an existing screen that uses one or more of the aforementioned axles.

STATE OF THE ART

Disc or star separator screens for waste generally consist of a plurality of rotating axles above which the material to be screened, for example waste, slides.

Such screens comprise a plurality of rotating axles suitably spaced apart from each other. Each axle has a plurality of discs or stars. The discs or stars of an axle are staggered with respect to the discs or stars of the subsequent axle, so that a disc or a star of the subsequent axle is interposed between each pair of discs or stars of an axle.

In a per se known manner, the discs or stars of each axle rotating integrally therewith move the waste forward along the screen, so that the waste fraction having dimensions smaller than the interaxle spacing between the axles (fine fraction) settles beneath the screen and the fraction having dimensions larger than the interaxle spacing (coarse fraction) settles at the end of the scree after traversing it longitudinally.

Suitably, for example as disclosed in the U.S. Pat. No. 4,972,959, an anti-clogging sleeve which rotates idle with respect to the axle is generally interposed between each pair consecutive discs or stars.

Thus, should waste be blocked between consecutive axles, the disc or star of an axle will drag the blocked waste downwards, while the idle anti-clogging sleeve of the other axle will counter-rotate to facilitate such dragging.

An acknowledged drawback of such screens lies in the fact that they tend to clog over time due to dust, pebbles or small particles of waste that penetrate between the anti-clogging sleeve and the axle and/or between the anti-clogging sleeve and the disc or star.

This causes malfunctioning, failures and/or overloads on the screen.

SUMMARY OF THE INVENTION

An object of the present invention is to at least partly overcome the drawbacks illustrated above, by providing a separator screen and/or an axle for the same and/or a method for modifying an existing separator screen that is highly efficient and relatively inexpensive.

Another object of the present invention is to provide a separator screen and/or an axle for the same and/or a method for modifying a separator screen capable of minimising the waste screening costs and/or times.

Another object of the present invention is to provide a separator screen and/or an axle for the same and/or a method for modifying a separator screen that allows long durability of the screen over time.

Another object of the present invention is to provide a separator screen and/or an axle for the same and/or a method for modifying a separator screen capable of minimizing the screen maintenance and/or downtime costs and/or times.

These objects, just like others that will be more apparent hereinafter, are attained by a screen, an axle and/or modification method as described, illustrated and/or claimed herein.

BRIEF DESCRIPTION OF THE DRAWINGS

Further characteristics and advantages of the invention will be more apparent in light of the detailed description of a preferred but non-exclusive embodiment of the invention, illustrated by way of non-limiting example with reference to the attached drawings, wherein:

FIGS. 25 and 26 are a lateral and axonometric view of a star 21, 21', while

DETAILED DESCRIPTION OF SOME PREFERRED EMBODIMENTS

Figure 1A:
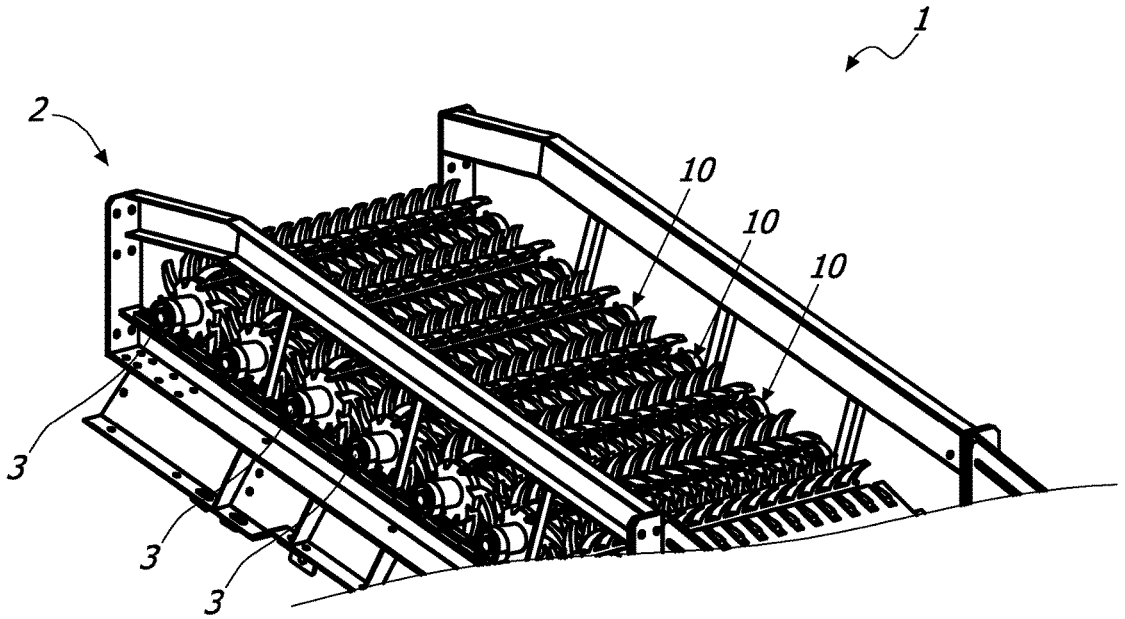
FIGS. 1A and 1B are a partial view respectively of a star screen 1 and a disc screen 1.
Figure 1B:
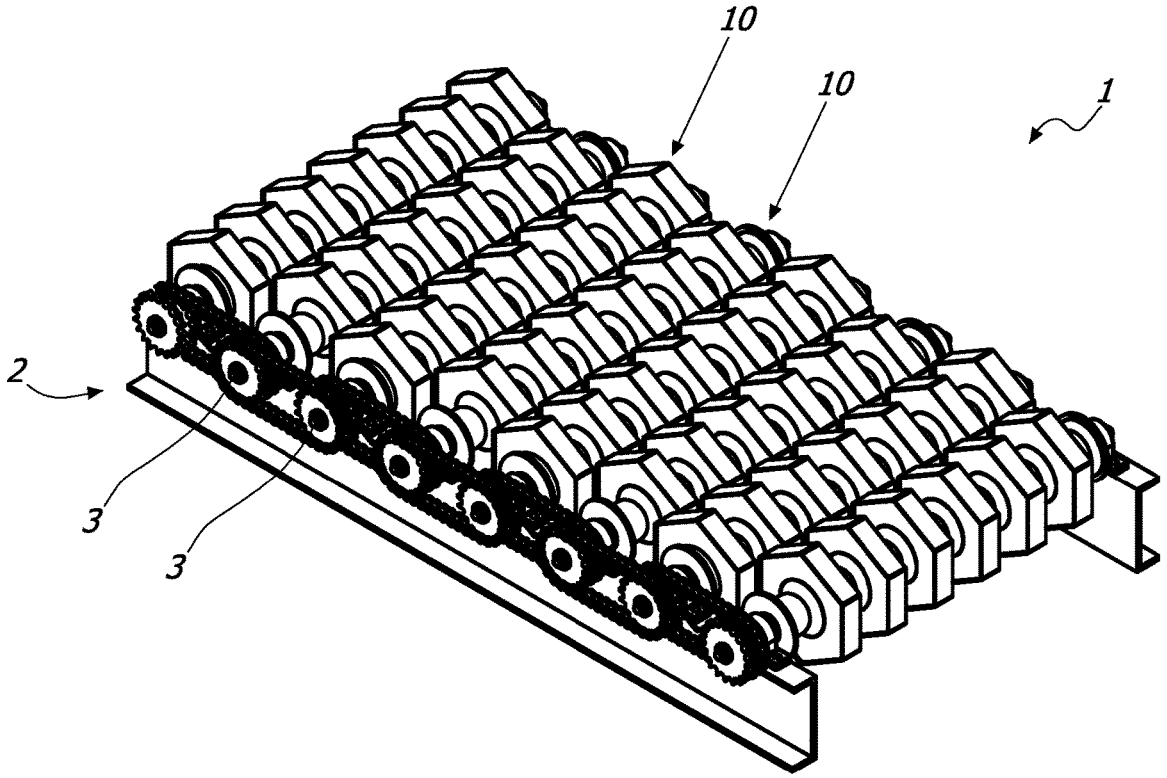
Figure 2:
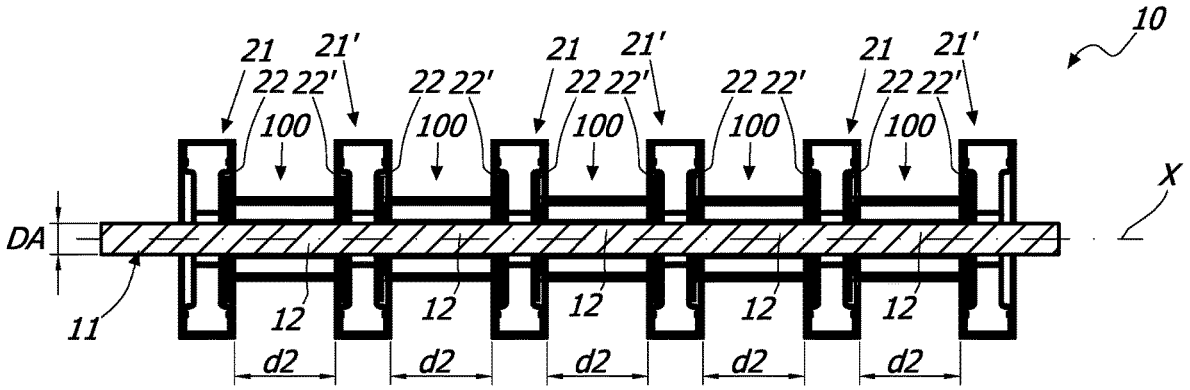
FIG. 2 is a partially sectioned schematic view of an axle 10.
Figure 3:
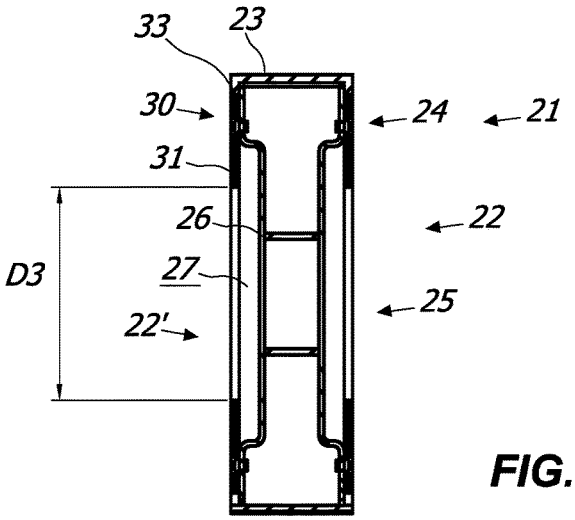
FIG. 3 is a partially sectioned schematic view of a disc 21.

With reference to the attached figures, herein described is a screen 1 particularly suitable for separating materials, such as for example solid waste. It is clear that such screen 1 may equally be used for separating any material.

It is clear that the screen 1 may be configured depending on the needs. For example, it may be flat or inclined, it may have a different length and/or width, it may be fixed, suitable to be driven or self-propelled autonomously.

Essentially, the separator screen 1 may comprise a support structure 2 and a plurality of support axles 10 each comprising a rotating shaft 11, a plurality of discs or stars 21, 21' and a plurality of anti-clogging sleeves 100 interposed between at least one pair of consecutive discs or stars 21, 21', preferably between each pair of consecutive discs or stars 21, 21'. One or more motors 3 of the per se known type may suitably be provided for driving such rotating shafts 11.

It is clear that the motors 3 may be configured depending on the needs. For example, they may have different power and/or dimensions.

Suitably, the rotating shafts 11 may rotate around a longitudinal rotation axis X which may coincide with the axle of the rotating shaft 11.

The support axles 10 may be arranged on the support structure 2 all substantially parallel to each other at a predetermined distance so that the respective axles X of the rotating shafts 11 are all substantially parallel to each other.

In particular, the discs or stars 21, 21' of two adjacent axles 10 may be staggered so that the outer surface 23 of the discs or stars 21, 21' is at the anti-clogging sleeves 100 of the adjacent axle 10.

Figure 13:
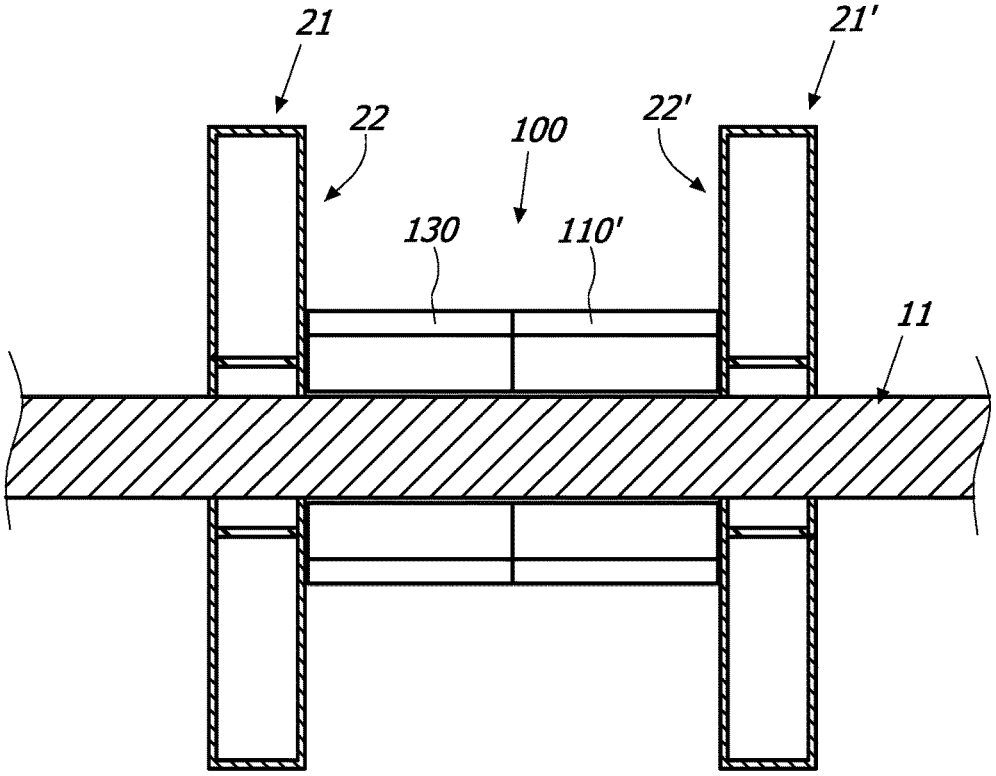
FIG. 13 is a schematic view of a different embodiment of an axis 10 comprising an anti-clogging sleeve 100 including an element 130 and an element 110'.

The screen 1 may thus comprise one or more axles 10 with a plurality of stars 21, 21' for example as illustrated in FIG. 1A or a plurality of discs 21, 21' for example as illustrated in FIG. 13.

For example, FIGS. 2 to 24 illustrate discs 21, 21' while FIGS. 25 to 30 illustrate stars 21, 21'.

Generally, the discs or stars 21, 21' may have a variable outer diameter and thickness depending on the needs.

However, it is clear that the discs 21, 21' may be discs having different shapes and sections, preferably substantially polygonal sections, for example hexagonal or octagonal.

Thus, though hereinafter reference is made to an axle 10 and to a screen 1 comprising the substantially hexagonal-shaped discs 21, 21', it is clear that such embodiment is not exclusive.

The anti-clogging sleeves 100 may thus be interposed between two consecutive discs 21, 21' which may have respective inner faces 22, 22' mutually facing each other.

Thus, the anti-clogging sleeves 100 may be interposed between the inner faces 22, 22' and may be arranged externally to the rotating shaft 11, and in particular they may be arranged externally to the portion 12 of the rotating shaft 11 interposed between two consecutive discs 21, 21'. Preferably, the anti-clogging sleeves 100 may be mounted idle on the rotating shaft 11.

In particular, the anti-clogging sleeve 100 may have an inner diameter DI substantially larger than the outer diameter DA of the portion 12 of the rotating shaft 11 so that the latter and the anti-clogging sleeve 100 rotate independently one with respect to the other.

Suitably, the distance d2 between the faces 22, 22' of the discs 21, 21' may be substantially greater than the length L1 of the anti-clogging sleeve 100 at the disc-shaped elements 110, 110' so as to allow the latter to rotate idle with respect to the respective disc 21, 21'.

Possibly, a spacer 90 may be interposed between the anti-clogging sleeve 100 and the portion 12 of the rotating shaft 11. The latter may have a particularly low thickness and it may have an inner diameter D9 substantially equal to or slightly larger than the outer diameter DA of the shaft 11.

Suitably, the opposite ends 91, 91' of the spacer 90 may be in abutment with the discs 21, 21' so that the length L9 of the spacer 90 defines the distance d2.

In this case, the anti-clogging sleeve 100 may be idle with respect to the spacer 90.

The anti-clogging sleeve 100 may thus be obtained as a single piece or, as better outlined hereinafter, it may comprise a plurality of elements idly coupled to each other.

Essentially, each anti-clogging sleeve 100 may include at least two adjacent rotating elements, at least one of which is configured as a tubular body.

Figure 14:
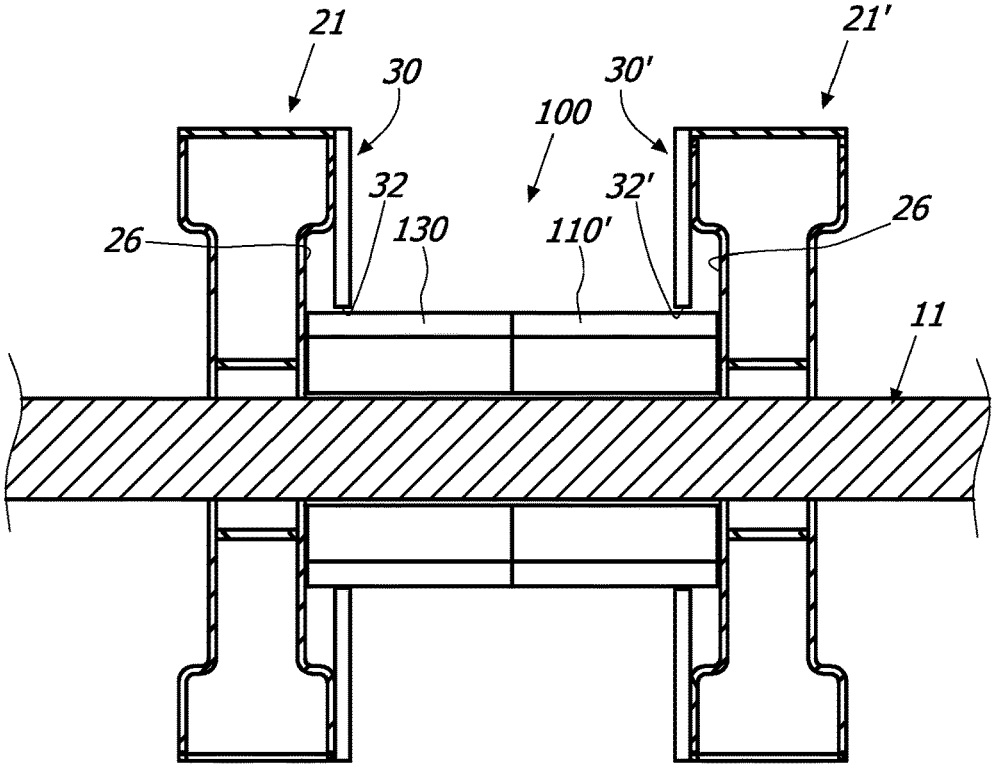
FIG. 14 is a sectional schematic view of some details of a different embodiment of an axis 10 comprising a pair of protection elements 30, 30' and an anti-clogging sleeve 100 including the element 130 and a pair of disc-shaped elements 110, 110'.

For example, as shown in FIGS. 13 and 14, the anti-clogging sleeves 100 may comprise a rotating element 130 and a rotating element 110' that can be positioned coaxially to the rotation shaft 11.

Preferably, the rotating element 130 and the rotating element 110' may be substantially arranged adjacent to each other.

Figure 4A:
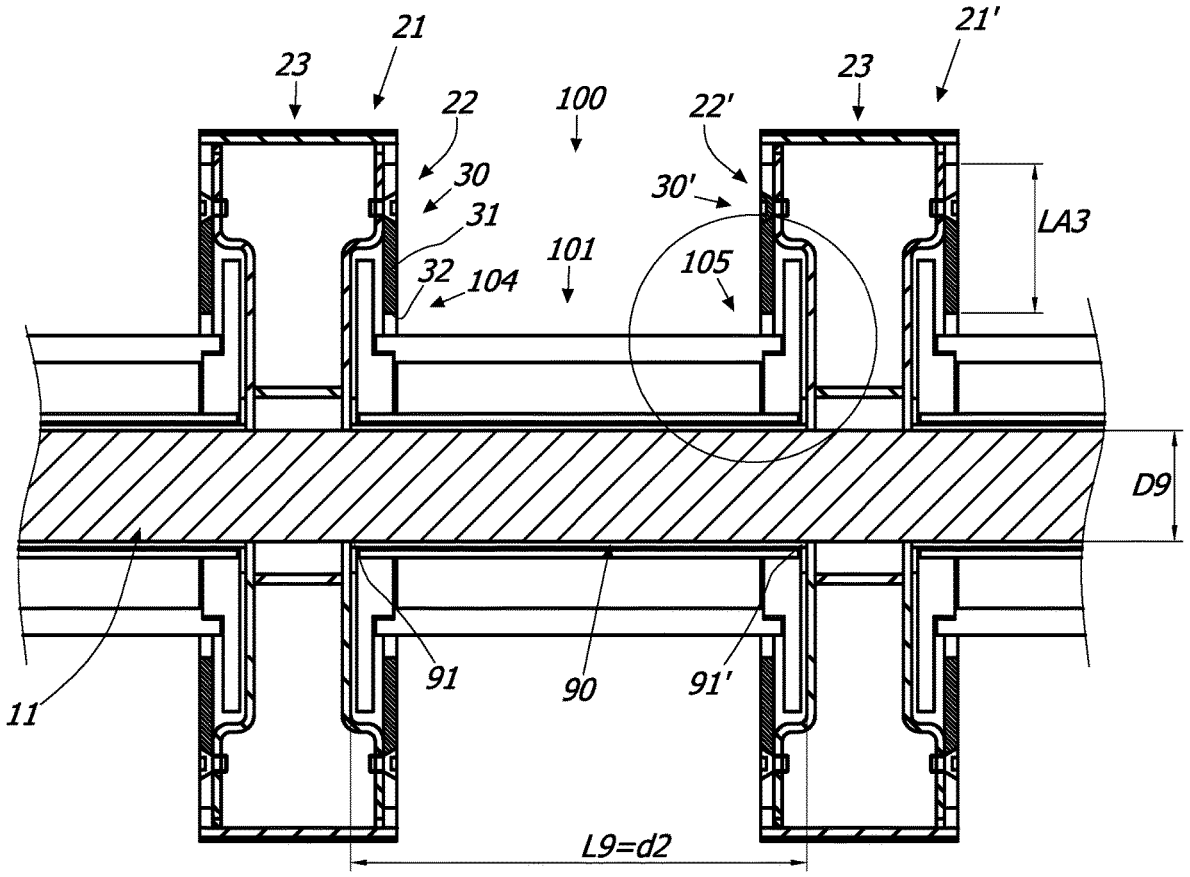
FIG. 4A is a sectional view of some details of the axle 10, with in FIG. 4B and FIG. 4C some enlargements respectively of FIG. 4A and of FIG. 4B.
Figure 11:
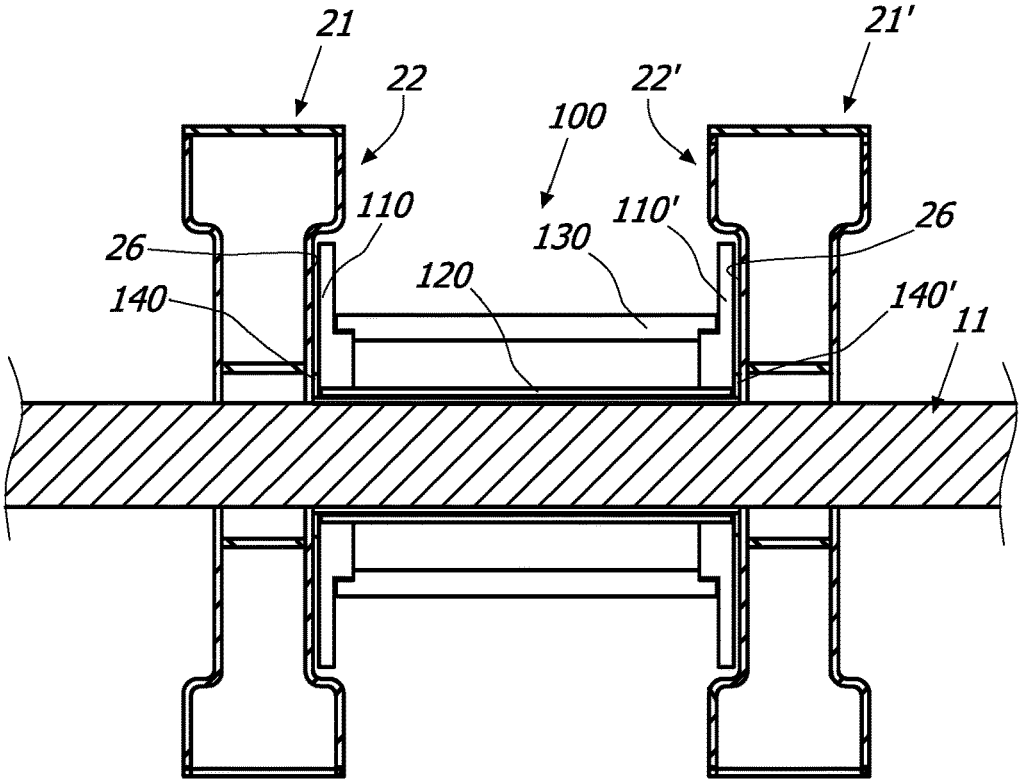
FIGS. 11 and 12 are a sectional schematic view of some details of different embodiments of an axle 10 comprising an anti-clogging sleeve 100 which includes an element 130 and a pair of annular elements 110, 110'.
Figure 12:
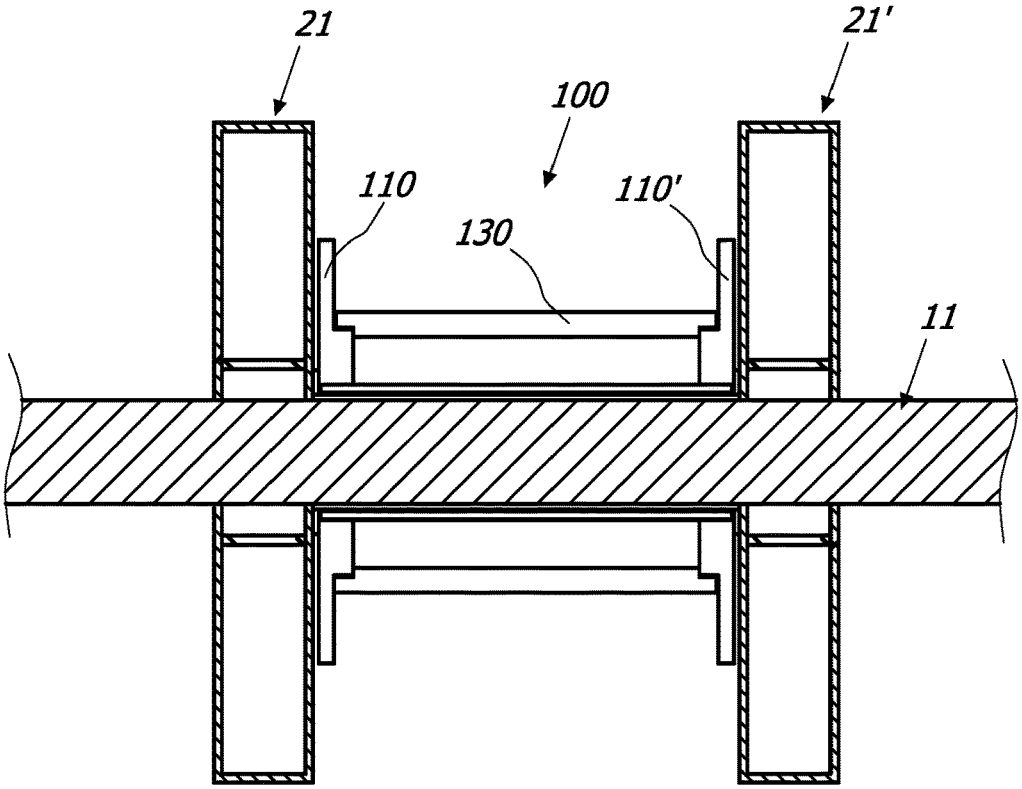

On the other hand, as shown in FIGS. 4*a*, 11 and 12, the anti-clogging sleeve 100 may comprise the rotating element 130 and a pair of rotating elements 110, 110' arranged on opposite sides with respect to the first.

In any case, such rotating elements 130, 110 and possibly 110' may be mounted idle on the rotation shaft so that the rotating elements 130, 110 and possibly 110' rotate independently one with respect to the other. In other words, each of the rotating elements 130, 110 and possibly 110' is mounted on the rotation shaft idle both with respect to the shaft and with respect to the other rotating elements.

Thanks to such characteristic, even should one of the rotating elements be blocked due to dust, pebbles or small particles of waste that penetrate between the anti-clogging sleeve and the axle and/or between the anti-clogging sleeve and the disc or star, the other rotating element or the other rotating elements continue to rotate.

This increases the efficiency and durability of the screen, minimising screening operations management costs as well as the screen maintenance and/or downtime times and costs.

Even though hereinafter reference will be made to the embodiment with three rotating elements for example illustrated in FIG. 4A, 130, 110 and 110', it is clear that the outlined characteristics and embodiments may also apply to anti-clogging sleeves consisting of a minimum of two rotating elements, according to the attached claims.

The anti-clogging sleeve 100 may comprise a substantially tubular-shaped central portion 101 and a pair of end portions 104, 105 designated to interact with the corresponding inner faces 22, 22' of the discs 21, 21'.

Suitably, the rotating element 130 may be a tubular body so as to define the central portion 101, while the end portions 104, 105 may comprise the rotating elements 110, 110'.

On the other hand, the rotating elements 110, 110' may be substantially disc-shaped. In particular, the tubular body 130 may have a first outer diameter D1, while the disc-shaped rotating elements 110', 110 may have a portion 112 with an outer diameter D4 substantially larger than the outer diameter D1.

In other words, the disc-shaped rotating elements 110', 110 may be disc-shaped appendages, or radial appendages, and they may have an extension substantially orthogonal to the axle X.

Furthermore, such disc-shaped elements 110', 110 may have a central hole in a manner such to be mounted idle on the rotation shaft 12.

According to a particular embodiment illustrated in FIGS. 4*a*, 11, 14, each face 22, 22' may have a peripheral portion 24 and a central portion 25 which may include an annular recess 26 defining a seat for the disc-shaped rotating elements 110, 110' of the anti-clogging sleeve 100.

The annular recess 26 may have a diameter D2 substantially equal to or slightly larger than the outer diameter D4 of the portion 112 of the disc-shaped elements 110, 110'.

Figure 5:
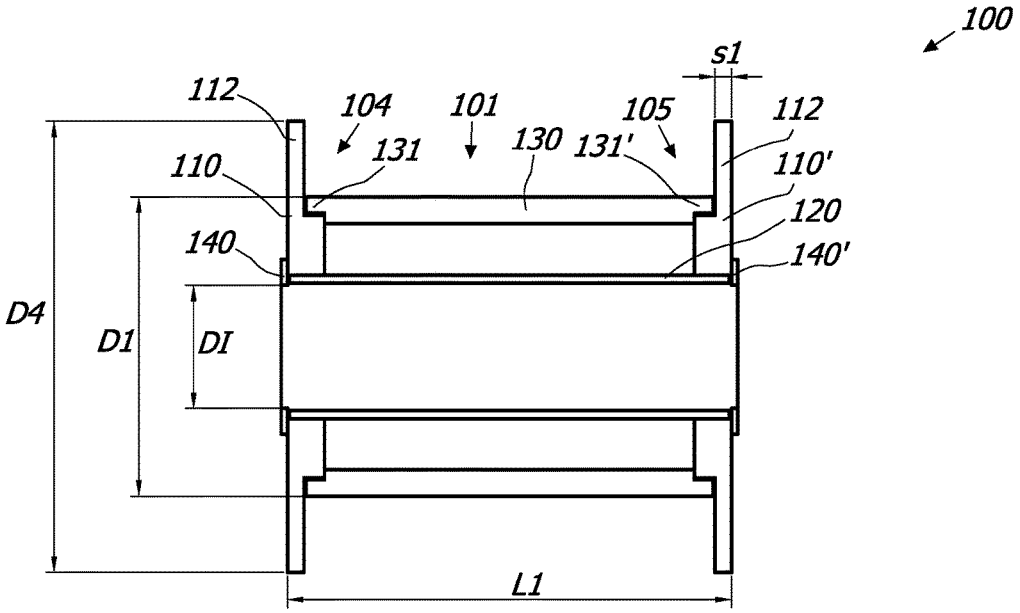
FIG. 5 is a sectional view of an anti-clogging sleeve 100 with a spacer 90.

Possibly, as illustrated in FIG. 5, the anti-clogging sleeve 100 may comprise a rotating element 120, the tubular body 130 and the pair of disc-shaped elements 110, 110' all of which may be rotating around the axis X and, preferably, all of them may be idle on the rotation shaft 11 so as to mutually rotate independently with respect to each other. Thus, all the elements 120, 130 and 110, 110' may generally have a respective axle which may be coaxial to the axle X or substantially coincident therewith.

Figure 4B:
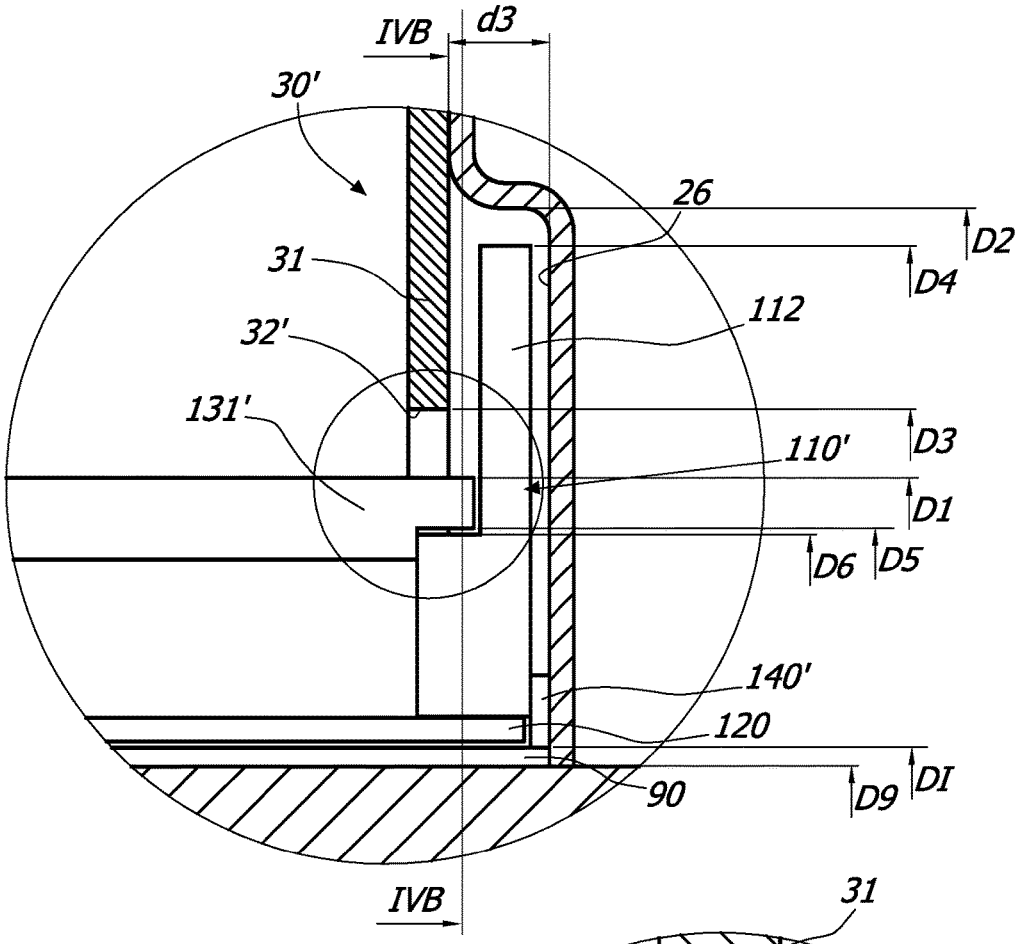
Figure 4C:
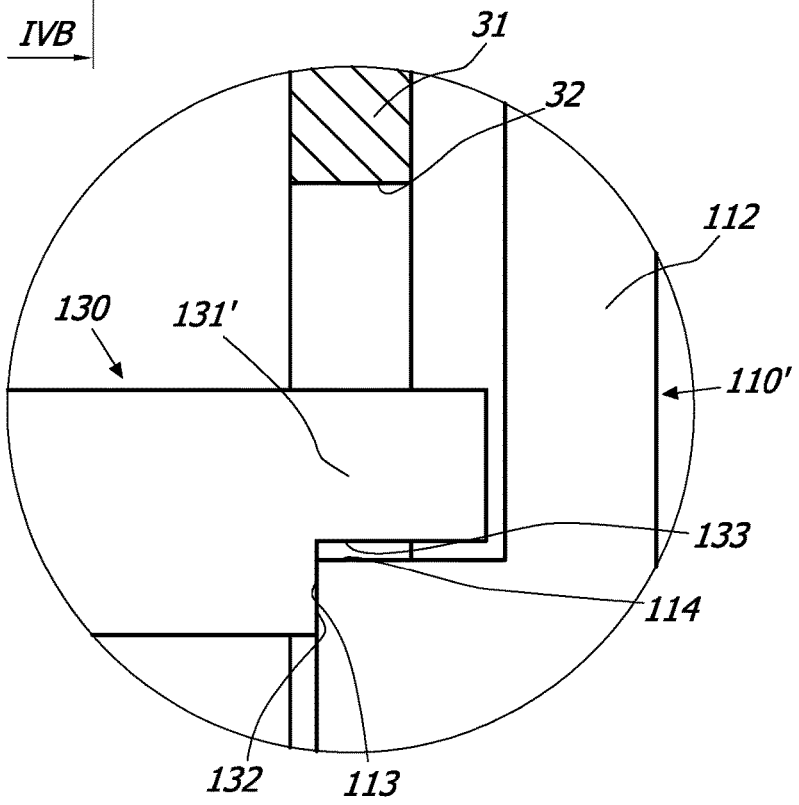
Figure 6:
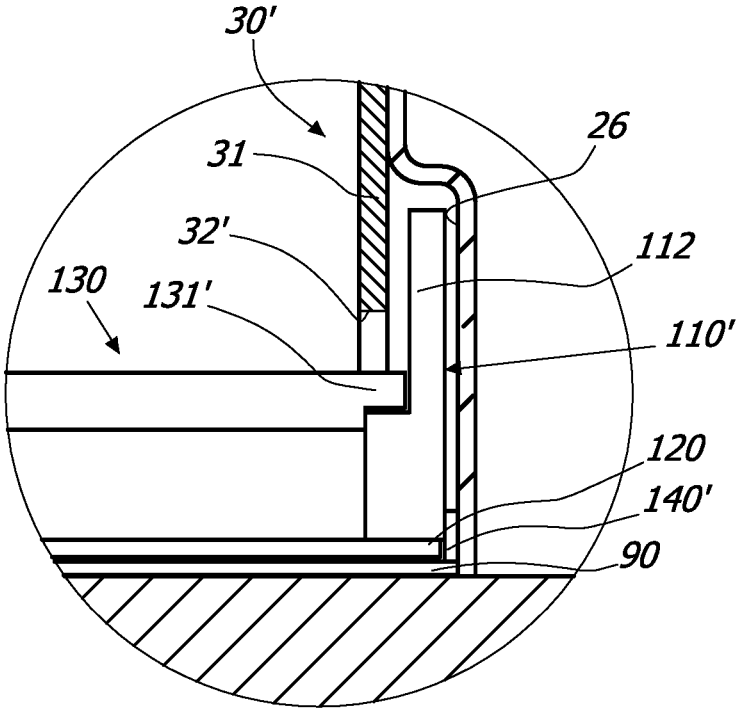
FIGS. 6 to 10 are a sectional view of some details of different embodiments of the anti-clogging sleeve 100.
Figure 7:
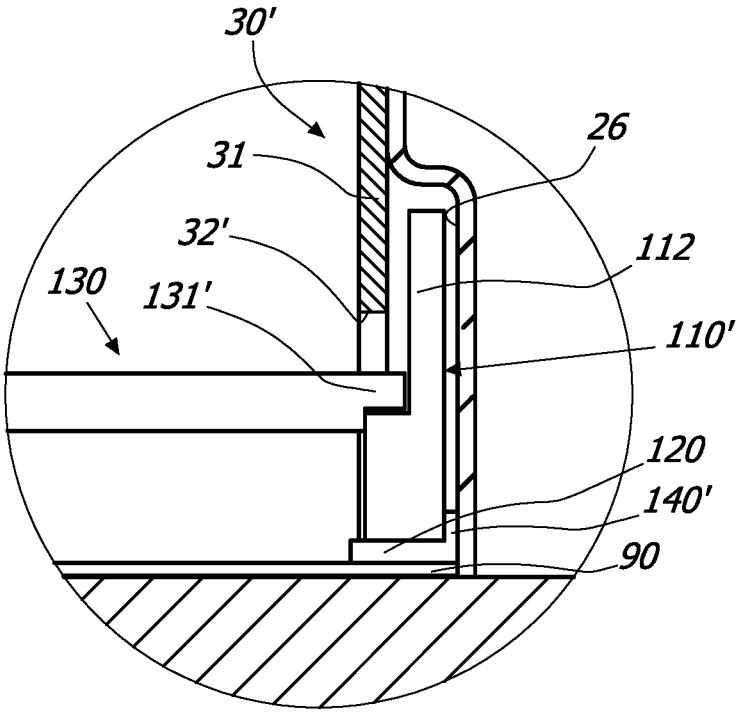
Figure 8:
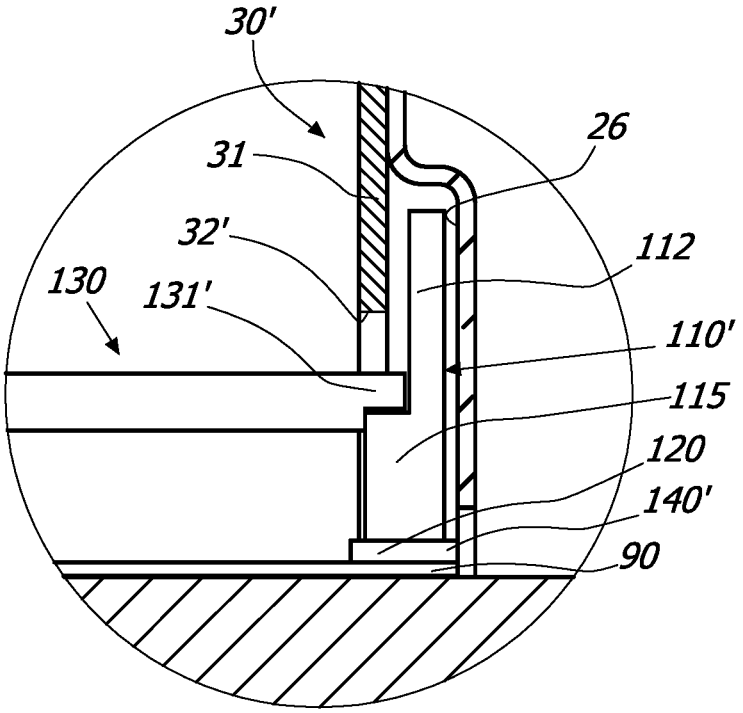
Figure 9:
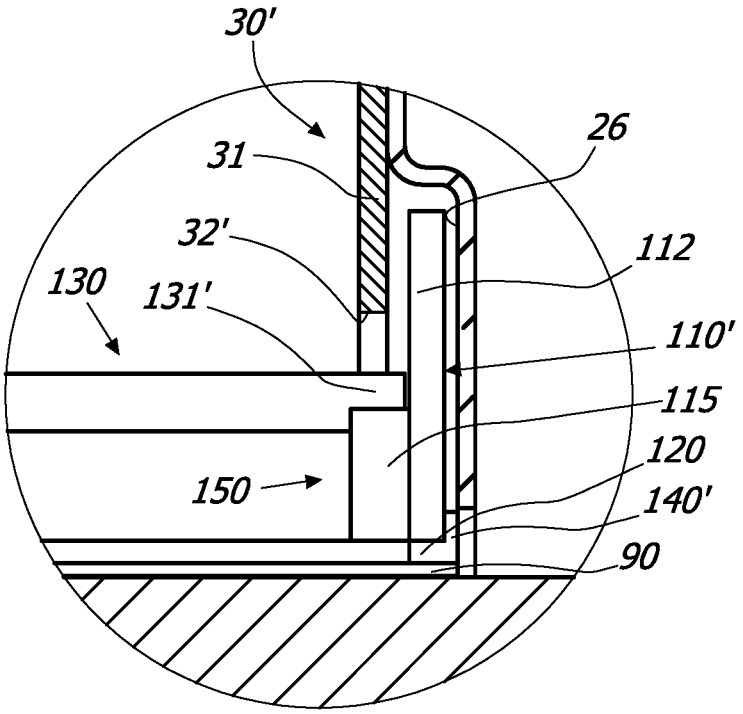
Figure 10:
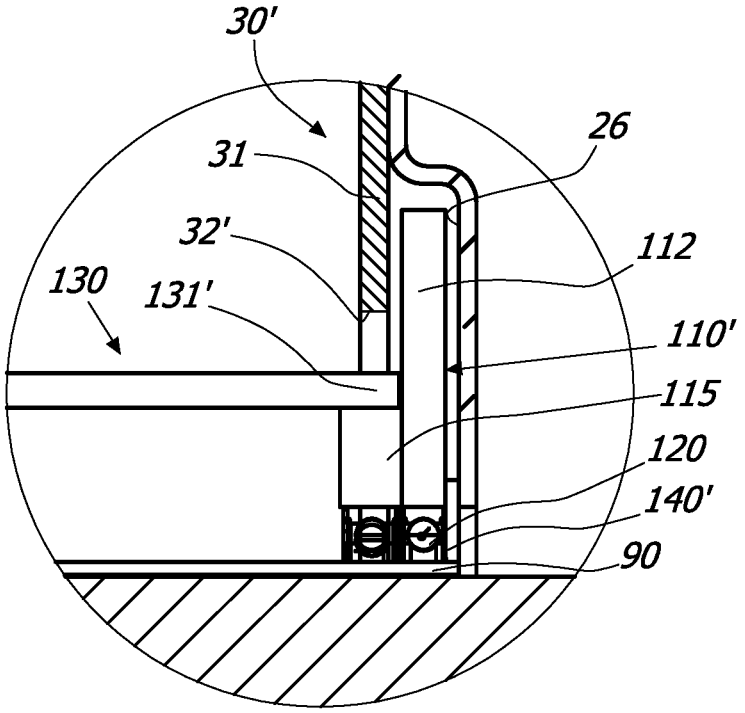
Figure 22:
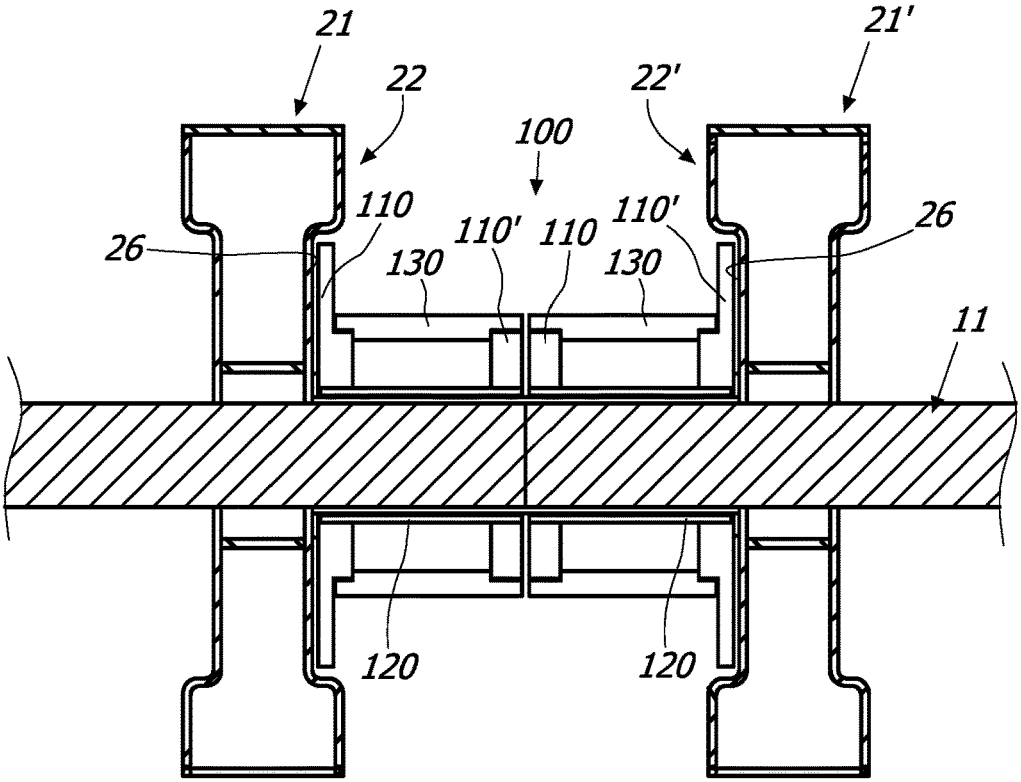
Figure 23:
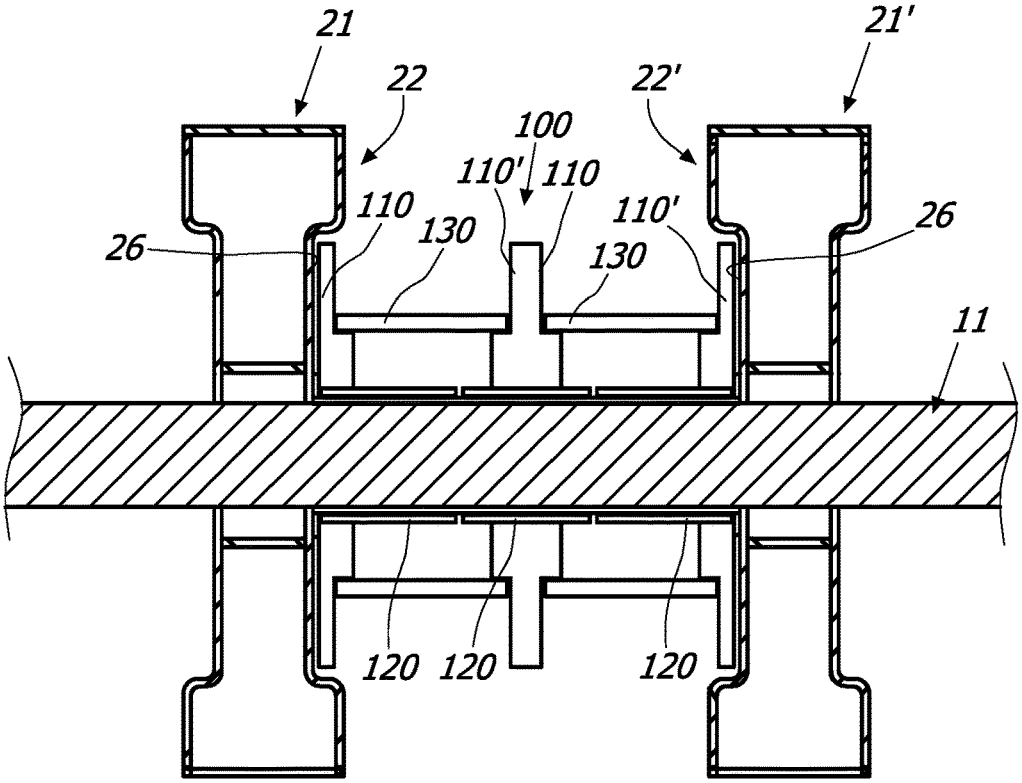
Figure 24:
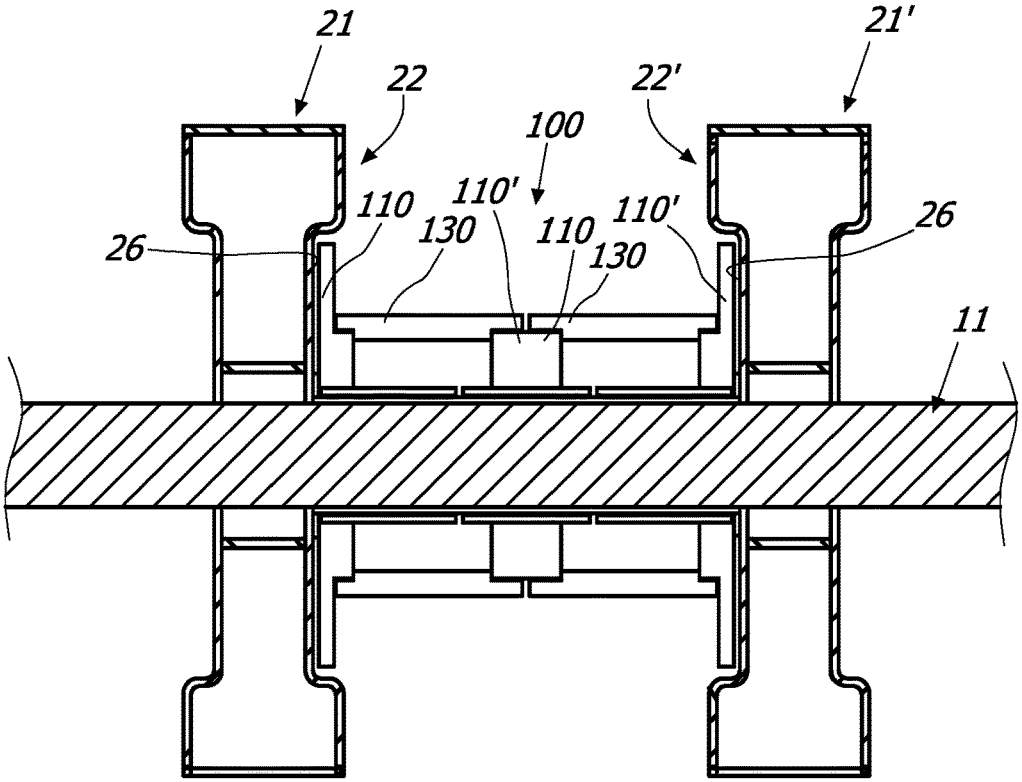

More in detail, the rotating element 120 may be substantially tubular-shaped as shown in FIGS. 4B, 6 and 9 or there may be provided for a pair of annular elements 120 as shown in FIGS. 7 and 8 or there may be provided for a pair of thrust-damping bearings as shown in FIG. 10, or there may be provided for several substantially tubular-shaped rotating elements, for example two (FIGS. 21 and 22) or three (FIGS. 23 and 24).

On the other hand, according to a particular embodiment, a plurality of tubular bodies 130 and disc-shaped elements 110, 110', for example as schematically illustrated in FIGS. 22, 23 and 24, may be provided for.

In any case, the rotating element 120 may be interposed between the disc-shaped elements 110, no' and the rotating shaft 12 or, if the spacer 90 is present, the rotating element 120 may be interposed between the disc-shaped elements 110, 110' and the spacer 90.

Possibly, in case of presence of several rotating elements 120, the latter may be interposed between the spacer 90 and each of the disc-shaped elements 110, 110', for example as illustrated in FIGS. 23 and 24. On the other hand, should a pair of tubular bodies 130 and a respective pair of disc-shaped elements 110, 110' be provided for, there may be provided for a pair of elements 120, each interposed between the pair of disc-shaped elements 110, 110' for example as schematically illustrated in FIG. 22.

It is thus clear that the inner diameter of the element 120 may define the inner diameter DI of the anti-clogging sleeve 100.

The tubular body 130 may comprise a pair of opposite ends 131, 131' susceptible to interact with the corresponding disc-shaped elements 110, 110'.

According to a particular aspect of the invention, the disc-shaped elements 110, 110' may each have at least one support portion 115 for rotatably supporting the opposite ends 131, 131' of the tubular body 130.

An anti-clogging sleeve 100 comprising a tubular body 130, a pair of disc-shaped elements 110', 110 will be described hereinafter for greater clarity. Such embodiment shall be deemed preferred but not exclusive.

The tubular body 130 may thus have—at the opposite ends 131, 131'—a maximum inner diameter D5, while the disc-shaped elements 110', 110 may have—at the respective support portions 115—a predetermined maximum diameter D6 smaller than the diameter D5 so that the rotation of the tubular body 130 is eccentric.

Figure 15:
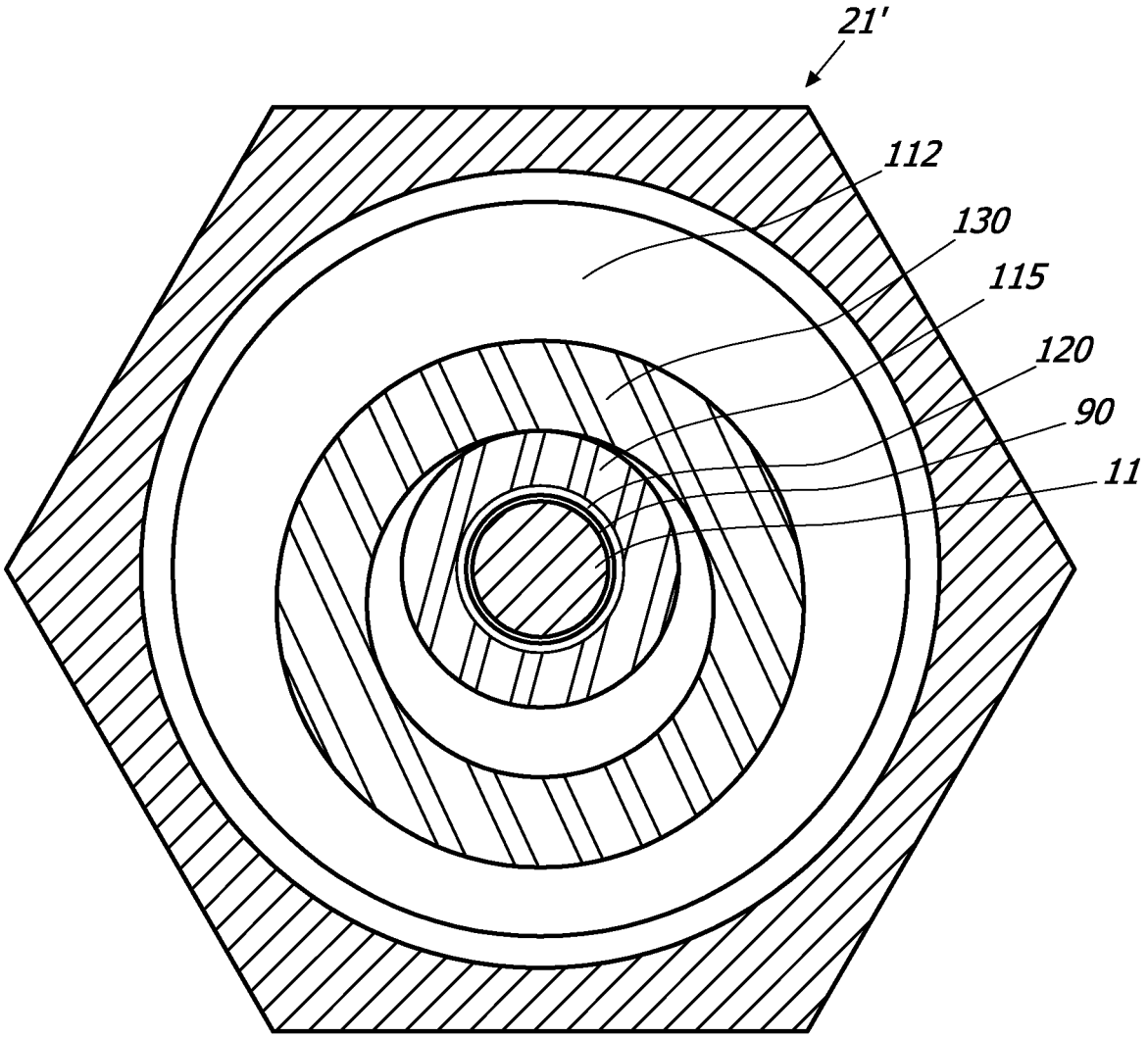
FIG. 15 is a sectional view taken along the section plane IVB-IVB of FIG. 4*b;*
Figure 16:
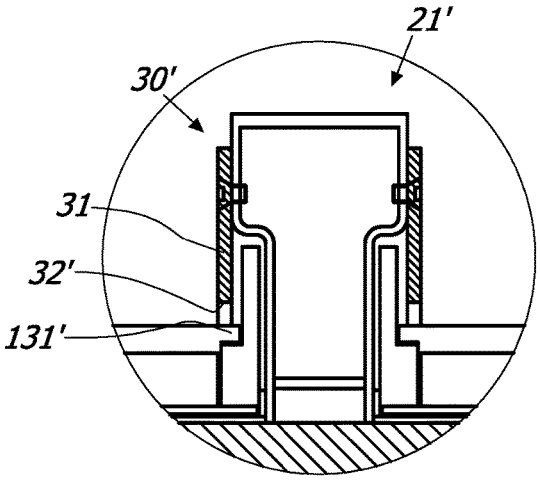
FIGS. 16 to 20 are a schematic view of some details of different embodiments of axles 10 with different embodiments of the protection elements 30.
Figure 17:
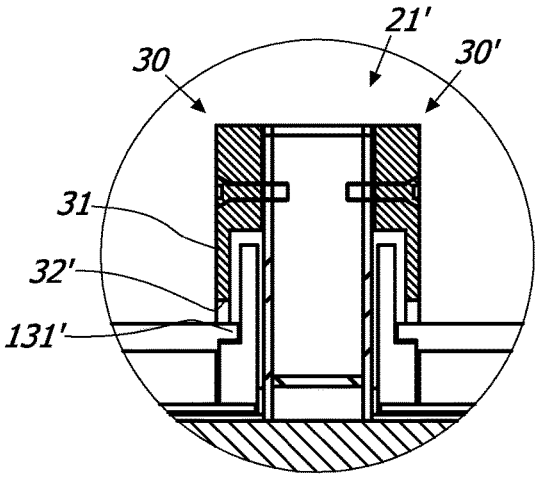
Figure 18:
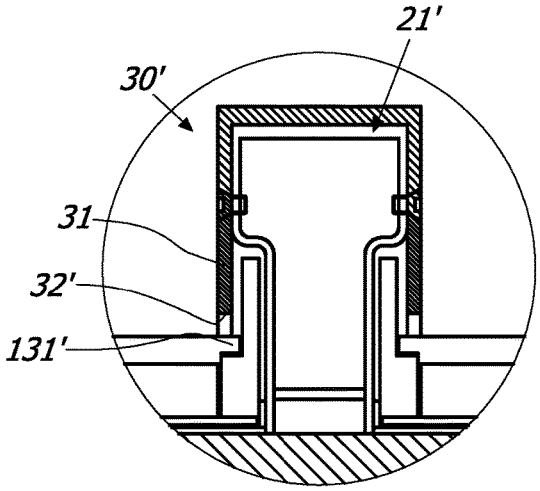
Figure 19:
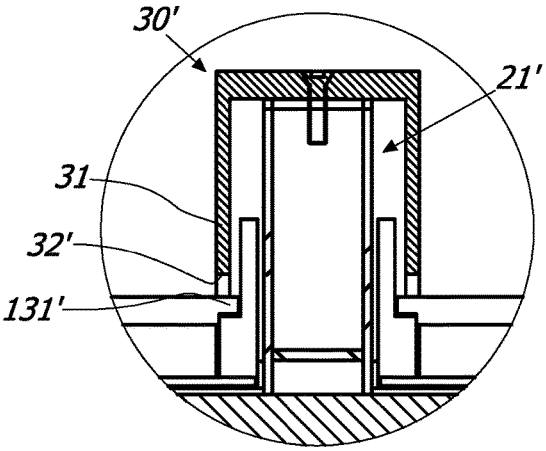
Figure 20:
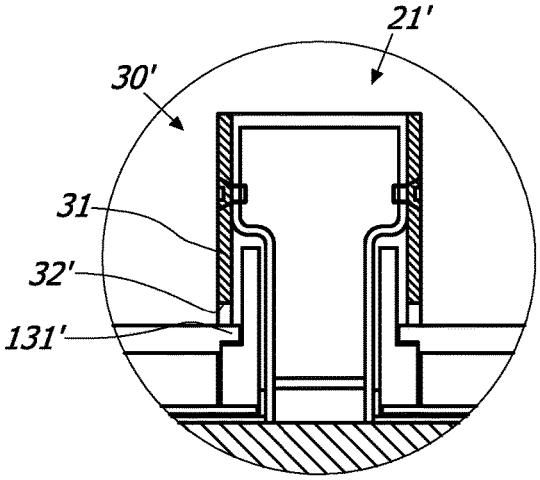
Figure 21:
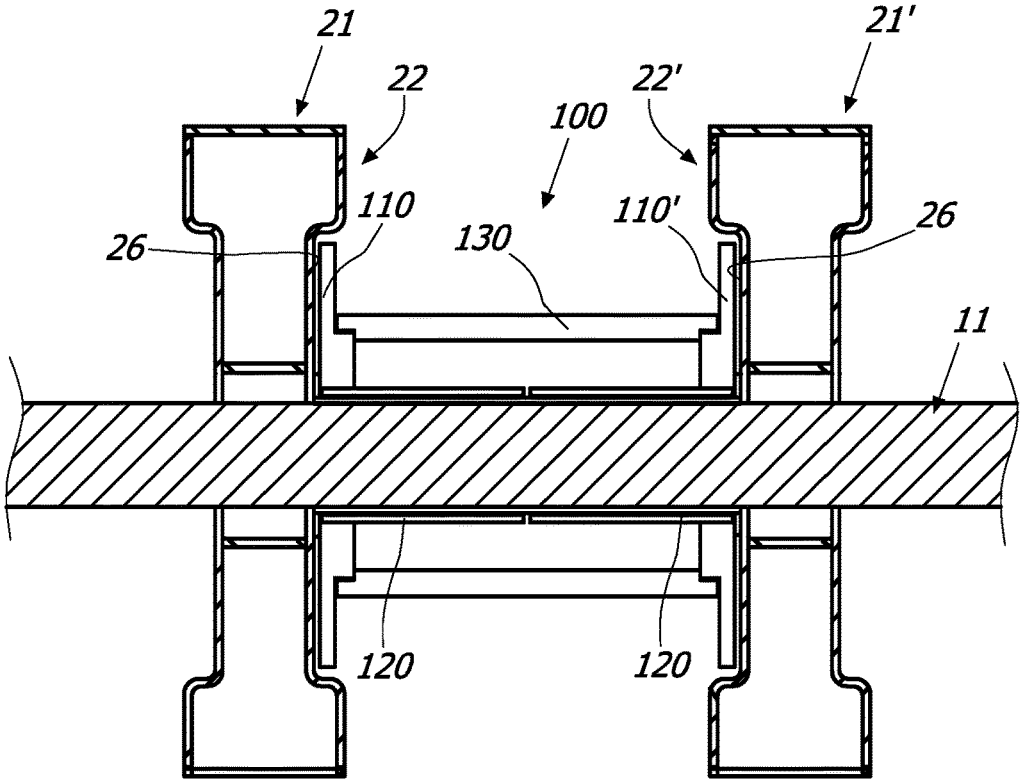
FIGS. 21 to 24 are a schematic view of some details of the axle 10 with different embodiments of the anti-clogging sleeve 100.

For example, as schematically illustrated in FIG. 15, the tubular body 130 and the support portion 115 may be mutually at contact only at a limited area of the same so as not to hinder the mutual rotation.

According to a particular aspect of the invention, each of the opposite ends 131, 131' may comprise at least one contact surface 132, while each of the disc-shaped elements 110', 110 may have at least one contact surface 113.

Preferably, the surfaces 132 and 113 may be at mutual contact during use.

This characteristic will allow to prevent the entry of waste into the anti-clogging sleeve 100 and into the tubular body 130 in particular.

Suitably, the tubular body 130 and the disc-shaped elements 110', 110 may be mutually dimensioned in the axial direction so that the contact surfaces 132 and the contact surfaces 113 are at mutual contact. In other words, the tubular body 130 may be axially constrained between the disc-shaped elements 110', 110.

Preferably, each end 131, 131' may comprise the surface 132 and a surface 133 substantially perpendicular to each other. The surface 132 may be perpendicular to the axis X, while the surface 133 may be substantially parallel thereto so as to form a step.

On the other hand, the disc-shaped elements 110, 110' may comprise the surface 113 and a surface 114 substantially perpendicular to each other so as form a step. The surface 113 may be perpendicular to the axis X, while the surface 114 may be substantially parallel thereto.

Suitably, the surfaces 132 and 113 may mutually abut against each other to axially constrain the anti-clogging sleeve 100, while the surfaces 133 and 114 may mutually abut against each other to radially constrain the anti-clogging sleeve 100.

Thanks to such characteristics, the spacer 90 may rotate with respect to the rotation shaft 12, the rotating elements 120 may rotate with respect to the spacer 90, the disc-shaped elements 110, 110' may rotate with respect to the rotating elements 120 and the tubular body 130 may rotate with respect to the disc-shaped elements 110, 110'. In other words, all such elements may be coupled idle to each other.

Should there be waste interposed between two or more such elements, for example between the tubular body 130 and the disc-shaped elements 110, 110' preventing the mutual rotation of the latter, the tubular body 130 may still be free to rotate with respect to the drive shaft 12 thanks to the presence of the rotating elements 120 and possibly of the spacer 90.

According to a particular aspect of the invention, a suitable anti-friction element 140, 140' interposed between at least one of the discs 21, 21' and the tubular body 130 or the disc-shaped element 110, 110' may be provided for.

Preferably, a pair of anti-friction elements 140, 140' interposed between the discs 21, 21' and the tubular body 130 and the disc-shaped element 110' may be provided for, or, preferably, the anti-friction elements 140, 140' may be interposed between the discs 21, 21' and the disc-shaped elements 110, 110'.

Such anti-friction elements 140, 140' may thus cause the mutual rotation of the disc-shaped elements 110, 110' and of the discs 21, 21'.

Preferably, the anti-friction elements 140, 140' may be annular elements.

In particular, the annular elements 140, 140' may be interposed between the elements 120 and 110, no' and the discs 21, 21' so as to keep the former spaced from the latter and cause the mutual rotation.

For example, the annular elements 140, 140' may be a pair of washers as shown in FIGS. 6 and 10.

On the other hand, as shown in FIGS. 7, 8 and 9, the elements 120 and the elements 140, 140' may be integrally joined to each other. For example, there may be provided for a pair of annular elements configured so that a portion thereof defines the rotating element 120 and a portion defines the anti-friction elements 140, 140'.

In this manner, the assembly of the anti-clogging sleeve 100 may have a small number of component parts thus reducing costs and assembly times.

According to a particular embodiment, damping means 150 interposed between the tubular element 130 and the shaft 11, preferably interposed between the tubular element 130 and the rotating elements 120 so as to damp a radial compression to which the tubular element 130 is subjected, may be provided for.

For example, the support portion 115 of the disc-shaped elements 110, 110' may be elastically deformable so that if deforms following a radial compression. As schematically illustrated in FIGS. 9 and 10, such portion 115 may be interposed between the surface 133 of the tubular element 130 and the rotating element 120.

It is clear that such embodiment is not exclusive in that the damping means may be of any type without departing from the scope of protection of the present invention.

Suitably, the distance between the first and the second rotating element 130, 110' or the first, second and third rotating element 130, 110' and 110 is minimum, for example smaller than 1 mm.

Such distance be such to allow the mutual idle rotation and minimise the possibility of dirt or foreign bodies entering therebetween.

Replacing one or more of the axles thereof with one or more of the axles described above may be sufficient to modify a disc or star screen of the prior art.

According to a particular aspect of the invention, a pair of protection elements 30, 30' which may be integrally coupled with the discs 21, 21', preferably with the peripheral portion 24 of the inner face 22, 22' thereof may be provided for.

Such protection elements 30, 30' may be configured so as to prevent the waste from being interposed between the faces 22, 22' of the discs 21, 21' and the anti-clogging sleeve 100.

In particular, the protection elements 30, 30' may extend from the peripheral portion 24. It is clear that such protection elements 30, 30' may have different configurations for example as schematically illustrated in FIGS. 16 to 20.

In any case, the protection elements 30, 30' may have a radial portion 31 having an inner diameter D3 which comprises an end portion 32, 32' which may be facing or at contact with the anti-clogging sleeve 100. It is clear that such end portions 32, 32' may be facing or at contact with different portions of the anti-clogging sleeve 100 depending on the configuration of the latter.

Preferably, the end portions 32, 32' may be facing or at contact with the tubular body 130. In such case, the inner diameter D3 of the radial portion 31 may be substantially equal to or slightly larger than the diameter D1 of the tubular body 130.

For example, in the embodiment illustrated in FIG. 14 the portions 32, 32' may be respectively facing the element 130 and the element 110', while in the embodiments illustrated from FIG. 6 to FIG. 10 the end portions 32, 32' may be facing the ends 131, 131' of the element 130.

The protection elements 30, 30' may be substantially annular-shaped and they may be obtained as single piece or as a plurality thereof. For example, two or more clamps or C-shaped elements that can be coupled to the discs 21, 21' in a per se known manner, for example by means of screws or welding, may be provided for.

It is clear that the protection elements 30, 30' may be substantially annular-shaped. For example, they may have a central hole which may be polygonal-shaped or, as described above, circular-shaped with an inner diameter D3. On the other hand, the protection elements 30, 30' may have a substantially circular or polygonal outer shape.

The annular protection elements 30, 30' may have an outer diameter substantially smaller than the outer diameter of the discs 21, 21'. In other words, the outer surface 33 of the protection elements 30, 30' may not project with respect to the outer surface 23 of the discs 21, 21'.

The annular protection elements 30, 30' thus configured may be particularly be used in star 21, 21' screens 1.

Possibly, the annular protection elements 30, 30' may have an outer diameter substantially equal to the outer diameter of the discs 21, 21' and the respective outer surfaces 23, 33 may be shaped in an identical manner to cooperate during use. For example, the protection elements 30, 30' and the discs 21, 21' may have a substantial hexagonal outer shape.

Described hereinafter are substantially annular-shaped protection elements 30, 30' with an inner diameter D3 and a hexagonal outer shape substantially identical to the hexagonal outer shape of the discs 21, 21'.

Thus, upon coupling the protection elements 30, 30' and the discs 21, 21', the former may preferably have an inner diameter D3 substantially larger or slightly larger than the outer diameter D1 of the anti-clogging sleeve 100.

More in detail, the inner portions 32, 32' may be substantially circular-shaped so that the diameter thereof defines the inner diameter D3.

In particular, the annular protection elements 30, 30' may have a width LA3 such that at least one portion 31 thereof remains facing the annular recess 26 so that the disc-shaped elements 110, 110' of the anti-clogging sleeve 100 remain at least partially interposed between the portion 31 and the annular recess 26.

The latter may have a diameter D2 slightly larger than the outer diameter D4 of the disc-shaped elements 110, 110'.

Suitably, the disc-shaped elements 110, 110' may comprise a portion 112 having a thickness S1 substantially smaller than the distance d3 between the portion 31 and the annular recess 26. In this manner, the disc-shaped elements 110, 110' may rotate idle with respect to the discs 21, 21'.

In other words, the annular protection elements 30, 30' and the annular recess 26 may thus cooperate to define an annular seat 27 for the portion 112 of the disc-shaped elements 110, 110'.

These characteristics will allow to prevent or limit the presence of waste between the anti-clogging sleeve 100 and the discs 21, 21', and in particular between the disc-shaped elements 110, 110' and the faces 22, 22' of the discs 21, 21' so that the screen 1 is particularly durable over time maintaining its effectiveness.

In other words, as particularly illustrated in FIG. 4B, the waste is forced to go through a "labyrinth-like" path before it can be interposed between the disc-shaped elements 110, 110' and the discs 21, 21'. Such characteristics, possibly combined with those described above, allow to obtain a highly effective screen.

Though herein described is an axle 10 comprising a plurality of discs 21, 21' with the protection elements 30, 30' and the annular seat 27 for the ends 104, 105 of the anti-clogging sleeve 100, it is clear that the anti-clogging sleeve 100 having one or more of the characteristics described above may be used with axles 10 without the protection elements 30, 30', as schematically illustrated in FIG. 11 and/or with axles 10 comprising discs 21, 21' without annular recesses 26 as schematically illustrated in FIG. 12.

According to a preferred but non-exclusive embodiment of the invention illustrated in FIG. 11, the axle 10 may comprise a plurality of discs or stars 21, 21' having the annular recess 26, and a plurality of anti-clogging sleeves 100 each comprising the disc-shaped elements 110, 110', the tubular body 130 interposed between the latter and the rotating element 120 and the pair of anti-friction elements 140, 140'.

Though described in the present document is an axle 10 with a plurality of discs 21, it is clear that the screen 1 may similarly comprise an axle 10 with a plurality of stars 21 having one or more of the characteristics described above.

Figure 25:
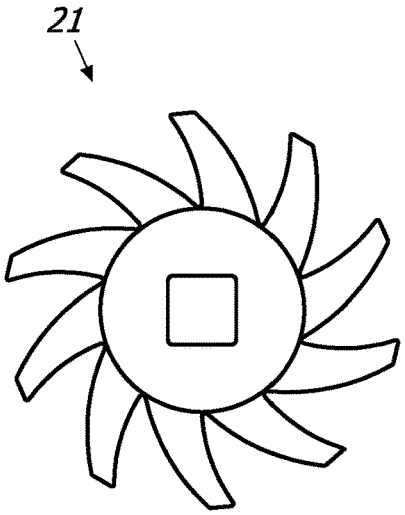
Figure 26:
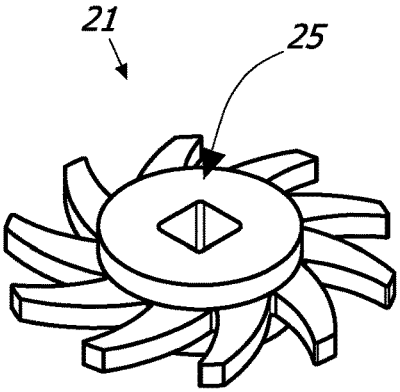
Figure 28:
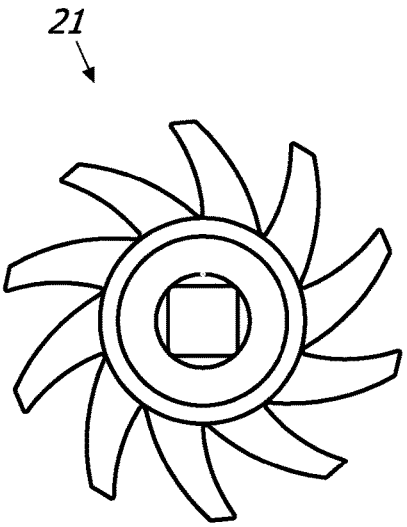
FIGS. 28 and 29 are a lateral and axonometric view of a star 21, 21' with a recess 26.
Figure 29:
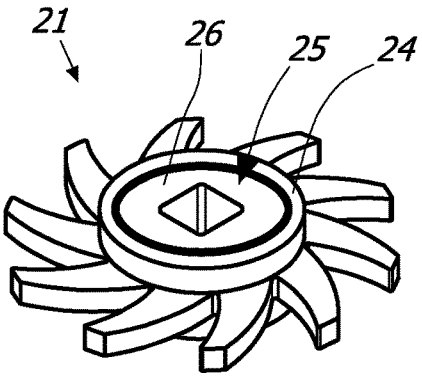

For example, FIGS. 28 and 29 show the star 21, 21' with the central portion 25 comprising the annular recess 26, while FIGS. 25 and 26 show the star 21, 21' with the central portion 25 without the annular recess 26.

Suitably, the axle 10 may thus comprise a plurality of stars 21, 21' and a plurality of anti-clogging sleeves 100 interposed therebetween. The latter may have one or more of the characteristics described above.

Figure 27:
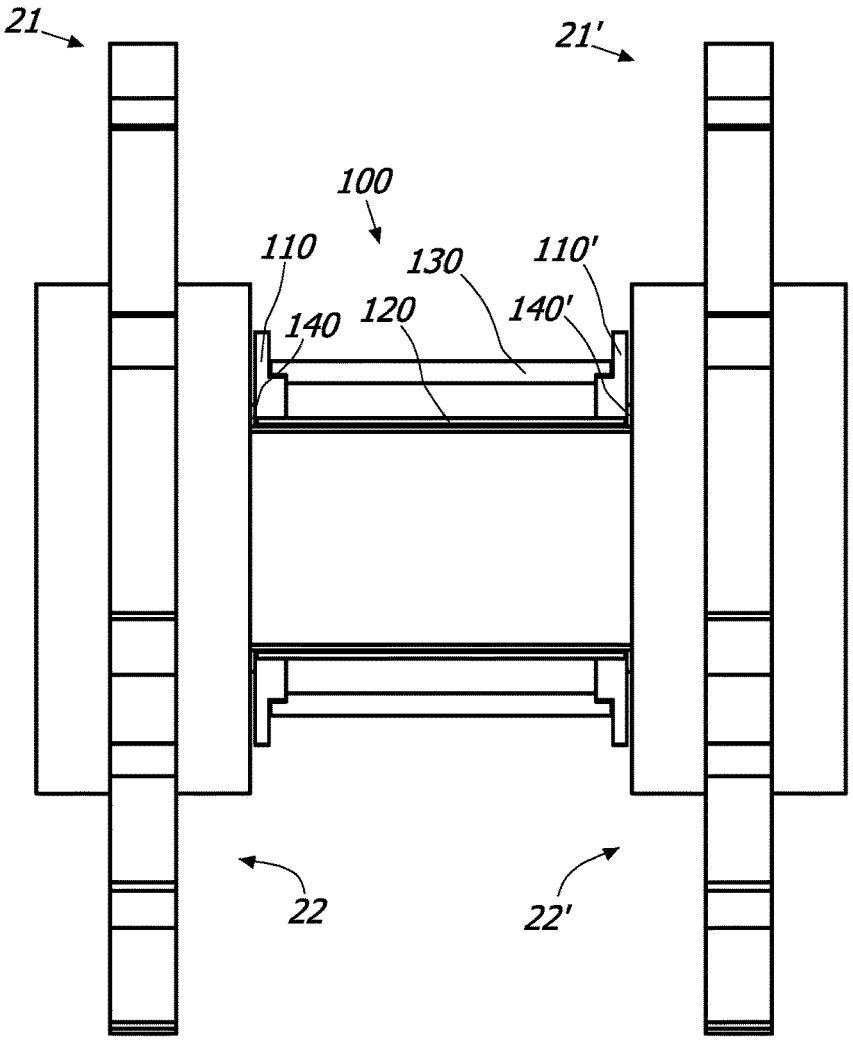
FIG. 27 is a partially sectioned lateral schematic view of some details of the star 21, 21' screen 1 with the anti-clogging sleeve 100.
Figure 30:
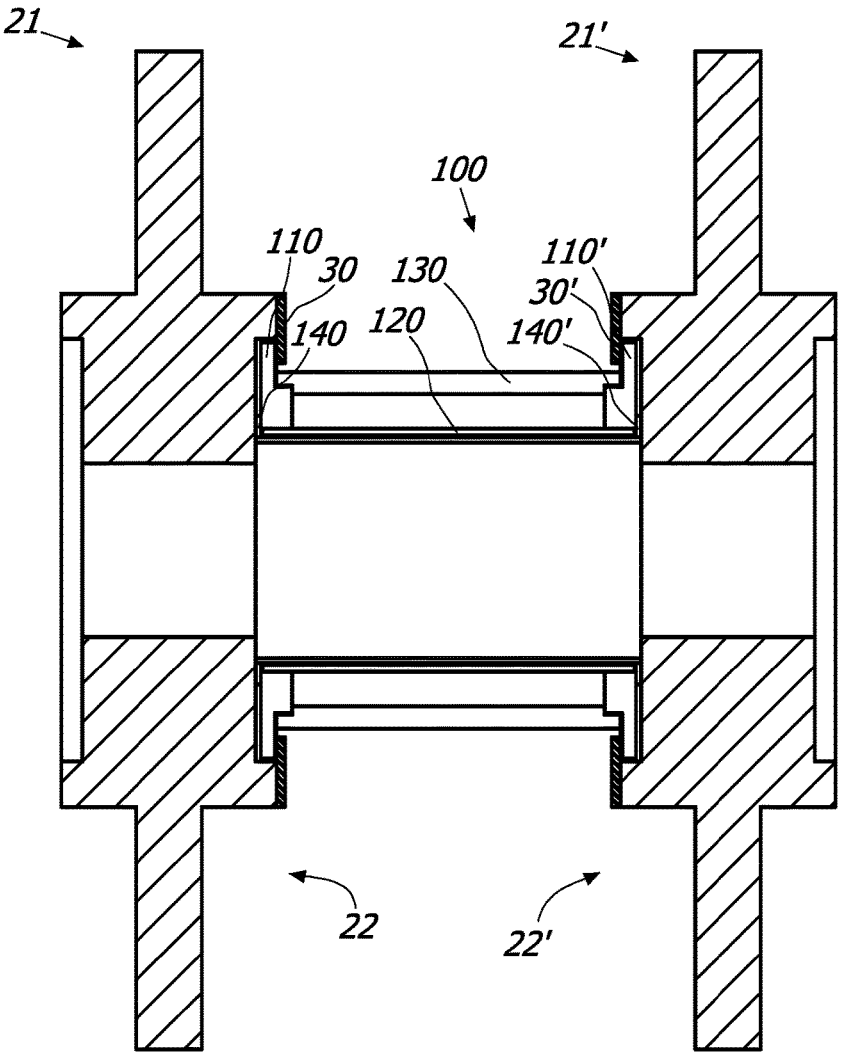
FIG. 30 is a partially sectioned lateral schematic view of some details of the star 21, 21' screen 1 with the anti-clogging sleeve 100 and with the protection elements 30, 30'.

For example, as illustrated in FIGS. 27 and 30, the anti-clogging sleeve 100 may comprise a tubular body 130, the disc-shaped elements 110, 110', the rotating element 120 and the pair of anti-friction elements 140, 140'.

According to a particular embodiment, the protection elements 30, 30' and the annular recess 26 may be provided for. In particular, the annular protection elements 30, 30' and the annular recess 26 may thus cooperate to define the annular seat 27 for the portion 112 of the disc-shaped elements 110, 110', for example as illustrated in 30.

According to a particular aspect of the invention, a screen 1 having the axle 10 and a plurality of discs or stars 21, 21' and a plurality of protection elements 30, 30' may be provided. The latter may be coupled to the discs or stars 21, 21' subsequently to obtaining the screen 1. In other words, a screen 1 and/or an axle 10 may be modified by coupling protection elements 30, 30' to the discs or stars 21, 21'.

Thus, an axle 10 may operatively be provided having the rotation shaft 11 and a plurality of discs or stars 21, 21' integrally coupled therewith. Suitably, each of the discs or stars 21, 21' may have a central portion 25 and a portion 24 peripheral thereto. The axle 10 may comprise a plurality of anti-clogging sleeves 100 mounted idle on the rotation shaft 11 each one of which may comprise at least one rotating element 130 interposed between a respective pair of discs or stars 21, 21'.

Thus, provided may be at least one pair of the protection elements 30, 30', preferably a pair of the latter for each disc or star 21, 21', and such protection elements 30, 30' may be coupled with the discs or stars 21, 21 so that the radial portion 31 extends from the peripheral portion 24 in a manner such that the end portion 32, 32' is facing or is at contact with the rotating element 130 so as to minimise the entry of dirt or foreign bodies therebetween.

It is clear that that the protection elements 30, 30' may be coupled with the discs or stars 21, 21 in a per se known manner, for example by means of a screw-lead-screw coupling.

The invention is susceptible to numerous modifications and variants all falling within the inventive concept outlined in the attached claims. All details can be replaced by other technically equivalent elements, and the materials can be different depending on the technical needs, without departing from the scope of protection of the invention.

The invention claimed is:

1. An axle useable in a disc or star separator screen (1) for waste, comprising:

a rotation shaft (11) defining a longitudinal axis (X);

a plurality of discs or stars (21, 21') integrally coupled with said rotation shaft (11); and a plurality of anti-clogging sleeves (100) coupled coaxially with said rotation shaft (11), each of said anti-clogging sleeves (100) being interposed between a respective pair of consecutive discs or stars (21, 21');

wherein each of said plurality of anti-clogging sleeves (100) has at least one first rotating element (130) and at least one second rotating element (110') arranged adjacent to each other, at least one of said at least one first rotating element (130) and at least one second rotating element (110') being a tubular body, said at least one first rotating element and said at least one second rotating element (130, 110') being mounted idle on said rotation shaft (11) so that said at least one first rotating element and said at least one second rotating element (130, 110') rotate independently one with respect to the other, so that one of said at least one first rotating element and said at least one second rotating element (130, 110') continues to rotate should another one of said at least one first rotating element and said at least one second rotating element (130, 110') block due to dirt or foreign bodies.

2. A separator screen comprising a plurality of axles (10) according to claim 1.

3. The axle according to claim 1, further comprising at least one third rotating element (110) arranged adjacent to one of said at least one first rotating element (130) and said at least one second rotating element (110'), said at least one third rotating element (110) being also mounted idle on said rotation shaft (11) so that said at least one first rotating element (130), said at least one second rotating element (110'), and said at least one third rotating element (110) rotate independently one with respect to the other.

4. The axle according to claim 3, further comprising at least one first anti friction annular element (140) interposed between at least one of said plurality of discs or stars (21, 21') and said at least one first rotating element and said at least one second rotating element (130, 110'), or at least one pair of first anti-friction annular elements (140) interposed between said plurality of discs or stars (21, 21') and said at least one first rotating element and said at least one second rotating element (130, 110') or said at least one second rotating element and said at least one third rotating element (110, 110').

5. The axle according to claim 3, wherein a distance between said at least one first rotating element (130) and said at least one second rotating element (110') or between said at least one first rotating element (130), said at least one second rotating element (110'), and said at least one third rotating element (110) is smaller than 1 mm.

6. The axle according to claim 3, wherein said at least one first rotating element (130) is interposed between said at least one second rotating element and said at least one third rotating element (110', 110), said at least one first rotating element (130) being said tubular body.

7. The axle according to claim 6, wherein said at least one first rotating element (130) has a first outer diameter (D1), said at least one second rotating element and said at least one third rotating element (110', 110) having at least one portion (112) with a second outer diameter (D4) greater than said first outer diameter (D1).

8. The axle according to claim 7, wherein said at least one second rotating element and said at least one third rotating element (110', 110) are disc shaped.

9. The axle according to claim 8, wherein each of said plurality of discs or stars (21, 21') has a central portion (25) facing said at least one first rotating element and said at least one second rotating element (130, 110') and a portion (24) peripheral thereto.

10. The axle according to claim 9, wherein said plurality of discs or stars (21, 21') have respective inner faces (22, 22') which comprises said peripheral portion (24), said central portion (25) of said respective inner faces (22, 22') including an annular recess (26), each of said at least one second rotating element and said at least one third rotating element (110', 110) being inserted into a respective annular recess (26).

11. The axle according to claim 9, wherein each of said plurality of discs or stars (21, 21') has at least one protection element (30, 30') extending from said peripheral portion (24) in a transversal or perpendicular direction with respect to said longitudinal axis (X), said at least one protection element (30, 30') including at least one annular-shaped radial portion (31) having a vacant end portion (32, 32') facing or in contact with said at least one first rotating element (130) so as to minimize an entry of the dirt or the foreign bodies therebetween.

12. The axle according to claim 6 wherein said at least one first rotating element (130) comprises a pair of opposite ends (131, 131'), said at least one second rotating element and said at least one third rotating element (110', 110) each having at least one support portion (115) for rotatably supporting the opposite ends (131, 131') of said at least one first rotating element (130).

13. The axle according to claim 12, wherein said at least one first rotating element (130) has, at said opposite ends (131, 131'), a first predetermined diameter (D5), said at least one second rotating element and said at least one third rotating element (110', 110) having, at the respective support portions (115), a second predetermined maximum diameter (D6) smaller than said first predetermined diameter (D5) so that a rotation of said at least one first rotating element (130) with respect to said at least one second rotating element and said at least one third rotating element (110', 110) is eccentric.

14. The axle according to claim 12, wherein each of said opposite ends (131, 131') comprises at least one first contact surface (132), each of said at least one second rotating element and said at least one third rotating element (110', 110) having at least one second contact surface (113), said at least one first rotating element (130) and said at least one second rotating element and said at least one third rotating element (110', 110) being mutually dimensioned in an axial direction so that said at least one first contact surface (132) and at least one second contact surface (113) are in mutual contact.

15. A method of modifying a separator screen (1) for waste, comprising:

providing an axle having, a rotation shaft (11) defining a longitudinal axis (X), a plurality of discs or stars (21, 21') integrally coupled with said rotation shaft (11), and a plurality of anti-clogging sleeves (100) mounted idle on said rotation shaft (11), each of said plurality of anti-clogging sleeves (100) being interposed between a respective pair of the plurality of discs or stars (21, 21'); and replacing said axle with a second axle according to claim 1.

* * * * *